United States Patent [19]

Alissandratos

[11] 4,317,605

[45] Mar. 2, 1982

[54] BRUSH HOLDER

[76] Inventor: Tacko D. Alissandratos, Box 606, Tarpon Springs, Fla. 33589

[21] Appl. No.: 179,400

[22] Filed: Aug. 19, 1980

[51] Int. Cl.[3] ..... A46B 17/00; A47B 67/02

[52] U.S. Cl. ..... 312/206; 312/242; 312/305; 312/326; 312/329

[58] Field of Search ..... 312/206, 242, 326, 329, 312/229, 305

[56] References Cited

U.S. PATENT DOCUMENTS

| | | | |
|---|---|---|---|
| D. 92,020 | 4/1934 | Rodstein et al. | 312/329 |
| 1,866,001 | 7/1932 | Amelotte | 312/206 |
| 1,952,686 | 3/1934 | Sakier | 312/206 |
| 2,254,431 | 9/1941 | Levine | 312/229 |
| 2,520,380 | 8/1950 | Wegman | 312/229 |
| 2,965,429 | 12/1960 | Stanger | 312/242 |
| 3,067,822 | 12/1962 | Hattenhauer | 312/242 |
| 3,211,509 | 10/1965 | Sender | 312/329 |
| 3,220,791 | 11/1965 | Pokryfke et al. | 312/326 |
| 4,033,650 | 7/1977 | Alissandratos | 312/242 |
| 4,084,867 | 4/1978 | Putt et al. | 312/229 |

*Primary Examiner*—Victor N. Sakran
*Attorney, Agent, or Firm*—Edwin E. Greigg

[57] ABSTRACT

A wall mounted enclosure device for a sanitary brush having a telescopically extensible handle and a rigid head at one end with its bristle face inclined with respect to the axis of said handle. A flange surrounds a portion of the handle adjoining said head adapted to suspend said brush from a bracket on the door of said enclosure device with respect to the pivotal mountings of the door thereof so as to maintain said door in closed position over said sanitary brush when not in use and to expose the brush for use.

5 Claims, 14 Drawing Figures

FIG. 7
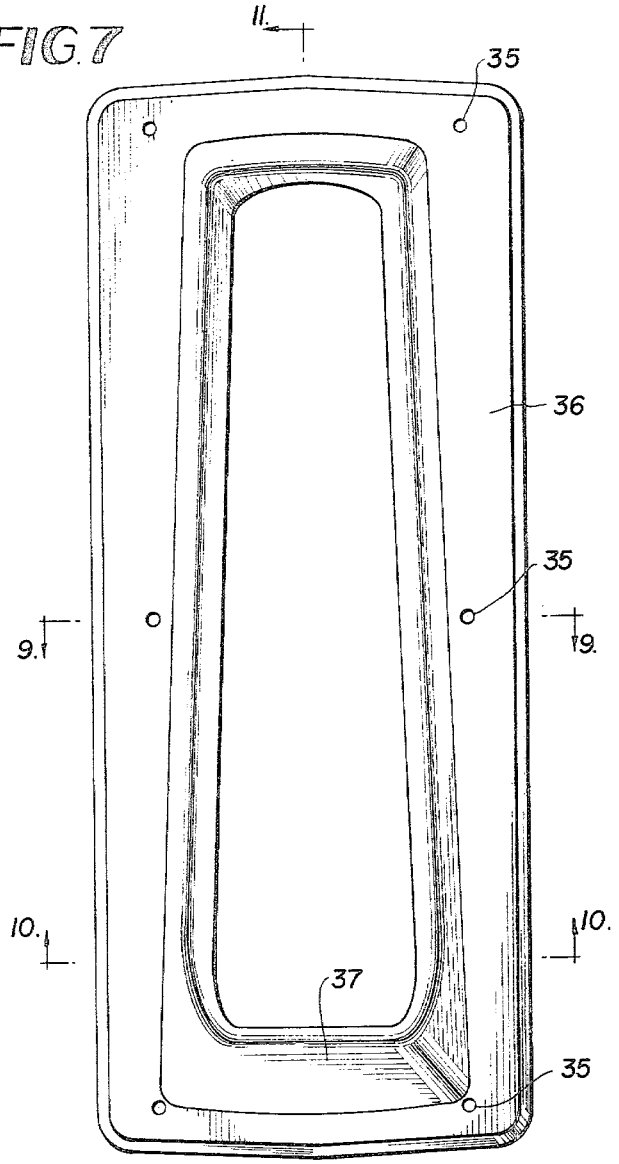
FIG. 8
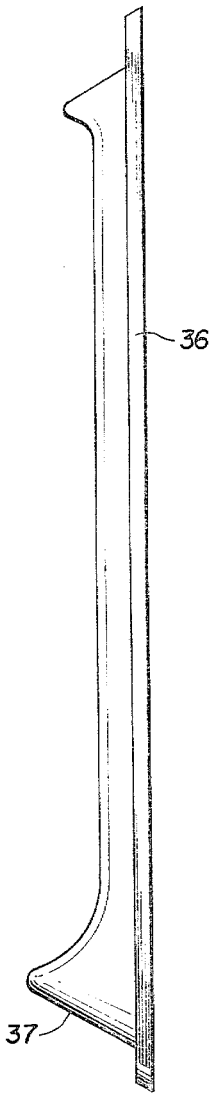
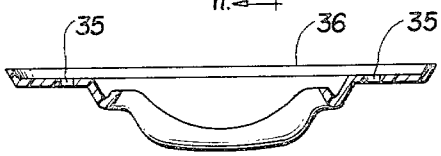
FIG. 9
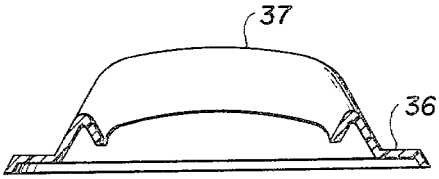
FIG. 10

BRUSH HOLDER

BACKGROUND OF THE INVENTION

Heretofore devices of this general type, while necessary, have been usually equipped for a brush having a long handle and as small a container as possible because of its use and appearance. As the device has been necessarily portable it is usually placed on the floor of the bathroom adjacent its source of most frequent use which has proven unsuitable, unsafe and unsightly. U.S. Pat. No. 4,033,650 is directed to a wall mounted brush holder similar to the present invention of which this invention is an improvement.

OBJECT AND SUMMARY OF THE INVENTION

As is pointed out above, the instant invention is directed to an improved construction and arrangement of parts that have proved both convenient and economical for more frequent use of the device by the average housewife to maintain her bathroom in a more desirable and sanitary condition. The construction of the device as a whole is such that it is more practical, safe and convenient to locate and maintain in a bathroom for the purpose stated. The frequently useable brush is normally unnoticeable in its convenient, yet hidden wall closure, when not in use. This invention comprises an easily assembled device of simple construction and with a hand grip for revolving the brush holder enclosure door.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 7 is a front view of a front enclosure for the housing;

FIG. 8 is a side view of the front enclosure;

FIG. 9 is a cross-sectional view of the front enclosure along lines 9—9 of FIG. 7;

FIG. 10 is a view along lines 10—10 of FIG. 7;

DESCRIPTION OF THE PREFERRED EMBODIMENT

Figure 1:
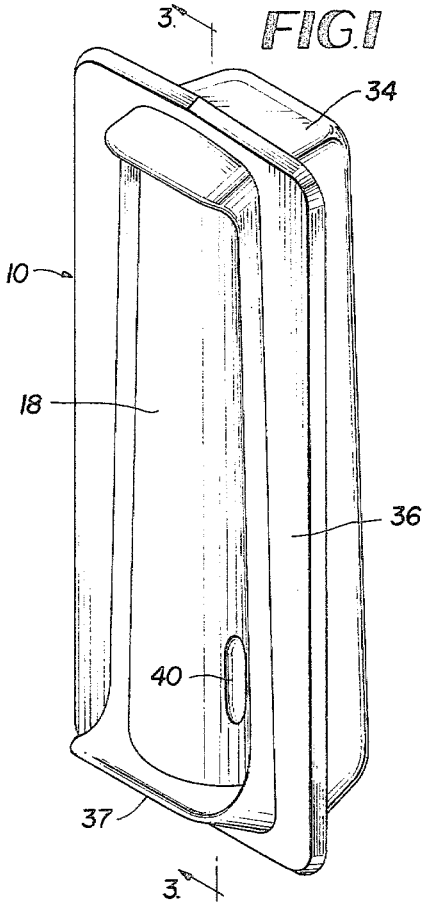
FIG. 1 is a view of the assembled device of this invention removed from the wall in which it is also designed for support.
Figure 2:
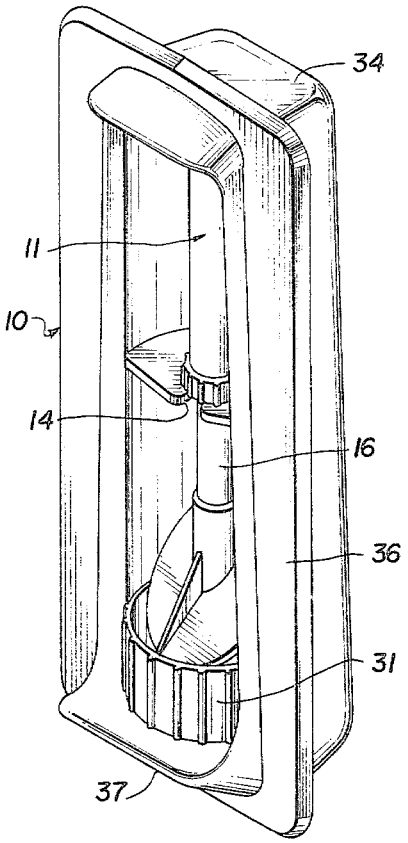
FIG. 2 is a view similar to FIG. 1 showing the normally closed door manually swung around to open position showing the door supported sanitary brush and drip cup carried thereby.

Referring now to FIG. 1, it will be noted that the wall mounted toilet bowl brush holder includes a rear housing, a front enclosure housing and a rotatable brush holder enclosure door supported within the rear housing. The toilet bowl brush holder is preferably constructed of a material which may be colored to match the tile of the bathroom wall in which it is to be mounted. It is obvious that this housing may be constructed of materials such as plastic, sheet or cast metal, a baked clay-like substance, etc., which is recessed to support and enclose the sanitary brush 11.

Figure 3:
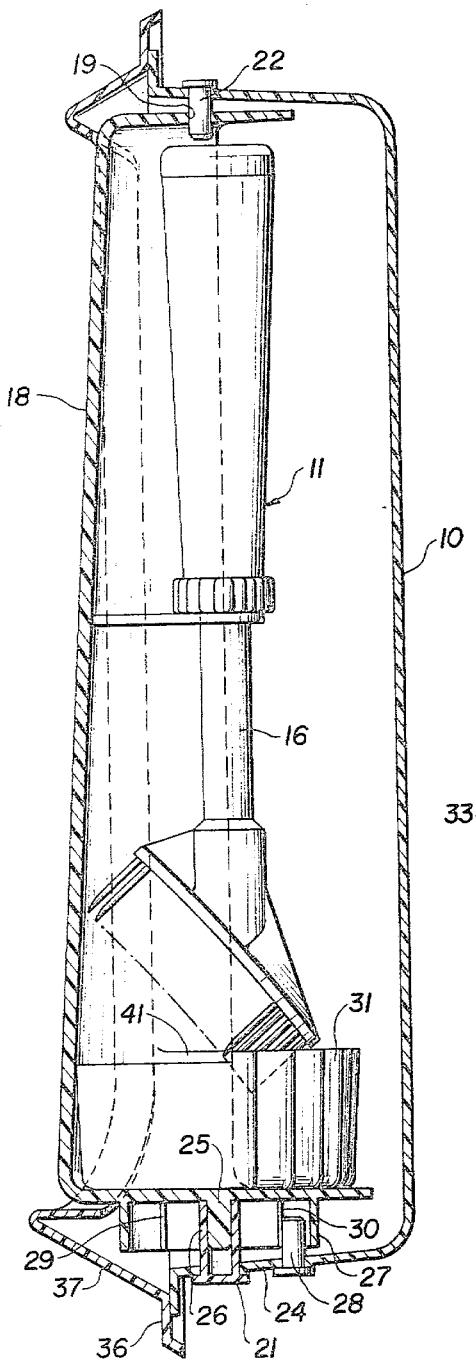
FIG. 3 is a further transverse vertical sectional view taken on the line 3—3 of FIG. 1, the parts being shown only partly in section but in the closed position as shown in FIG. 1.

The brush 11 is supported on a revolving closure door 18 which is semicircular in cross section with a circular bottom, including a bracket-like shelf 12 integral with the door and includes a front entrance slot 13 and is depressed around its inner side edges as at 14 to provide a suitable seat for retaining the lower tubular handle section 16 of the sanitary brush. The body of the housing is normally closed across the front when the brush is not in use by the pivotally mounted brush holder enclosure door 18, the body of the brush holder enclosure door 18 is centrally recessed along its length in opposition to the recessed body of the rear housing 10 when in the normal closed position as shown in FIGS. 1 and 3 to support the sanitary brush 11 and to enclose the same within the recessed body of the rear housing 10. The rear housing is formed by rectangular-like ends, sides and bottom to form an open rectangular shell. The upper and lower pivotal mountings 20 and 21, respectively, for the enclosure door 18 are best shown in FIG. 3. The upper pivotal mounting 20 includes a pin 22 which extends through a hole 15 in the upper end of the rear housing 10 into a hole 19 in the closure door 18 about which the upper end of the door pivots. The lower pivotal mounting 21 of the door 18 is mounted in the bottom closure wall 24 of rear housing 10. The bottom of the closure door 18 is made with an integral pivot pin 25 which fits into a pin bushing 26 inserted through a hole 27 in the bottom of the rear housing 10 on the axis of the pin 22 at the top of the housing. The bottom of the closure door is also provided with a downwardly extending arcuate semicircular skirt 27. A stop pin 28 is inserted through the bottom wall of the housing toward the bottom of the enclosure door. The closure door rides on and rotates about the pin bushing 26 and is provided with downwardly extending spaced ribs 29 and 30 which protrude from the skirt and serve as stops. The ribs 29 and 30 cooperate with the stop pin 28 in order to stop the enclosure door in either an open or closed position. The brush 11 will thus be supported in a good position for its removal from the bracket shelf 12 spanning the recess in the side of the enclosure door 18. A drip cup 31 is shown mounted on the bottom floor of the pivotal door 18 so as to prevent any dripping from the brush, after use, contaminating the lower or bottom pivotal point 21.

Figure 4:
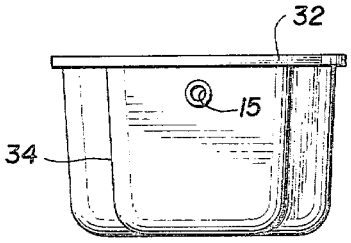
FIG. 4 is a top view of the rear housing.
Figure 5:
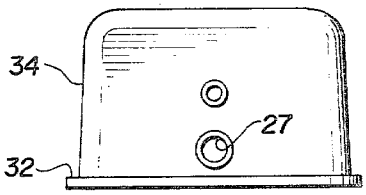
FIG. 5 is a bottom view of the rear housing.
Figure 6:
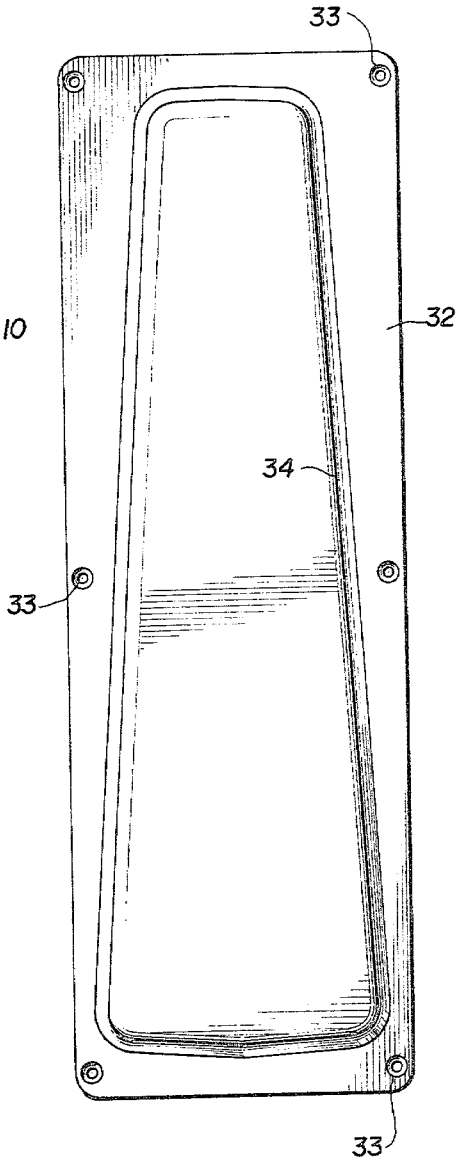
FIG. 6 is a front view of the rear housing.
Figure 11:
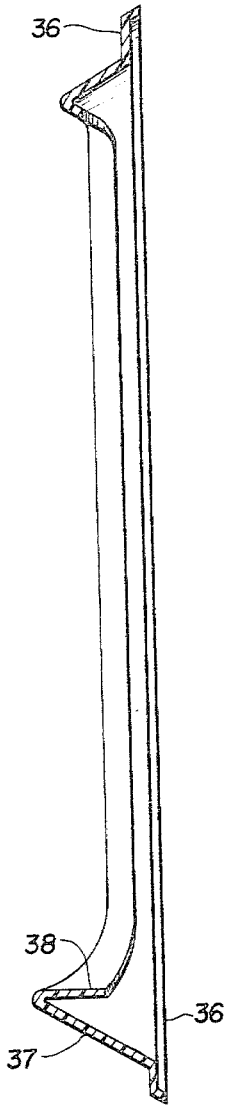
FIG. 11 is a view along lines 11—11 of FIG. 7.
Figure 12:
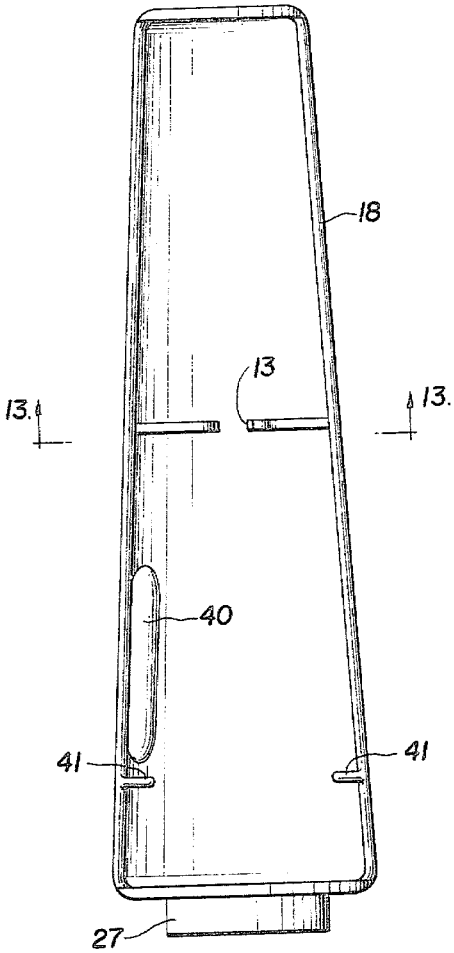
FIG. 12 is a view showing the inside of the door closure looking toward the brush holder.

FIG. 4 is a top view of the rear housing 10 which more clearly shows the hole 15 through which the pivot pin is inserted and the general shape of the rear housing looking from the top. FIG. 5 illustrates a bottom view of the rear housing, more clearly showing the general shape of the rear housing as looking from the bottom. FIG. 6 is a front view illustrating the view from the front. As seen in the views of FIGS. 3–6, the rear housing is provided with a flange 32 extending outwardly from the main body. As seen in FIG. 6, the side walls 34 converge toward each other from the bottom toward the top where the angle of convergence is about 30° with the vertical. The corners are rounded into smooth lines as seen in FIGS. 4–6. The flange is provided with non-threaded holes 33 which are countersunk from the back side by which the front closure housing is secured to the housing.

FIGS. 7–11 illustrate different views of the front housing enclosure. The front housing enclosure has an overall shape which conforms with the rear housing and is provided with six threaded holes 35 in the flange 36 which mate with the holes in the rear housing by which the front closure is secured to the back housing. The front wall of closure 37 extends inwardly toward each other and outwardly on an angle from a flange at an angle of about 30° with the horizontal, to a horizontal portion 38 that extends back toward the plane of the flange, as seen in the cross-sectional view of FIGS. 9–11. The wall so formed surrounds the brush holder enclosure door 18. The opening has the general shape of the opening in the rear housing. The front housing bounds the rotatable brush holder enclosure to provide a nice looking wall mounted brush holder.

Figure 13:
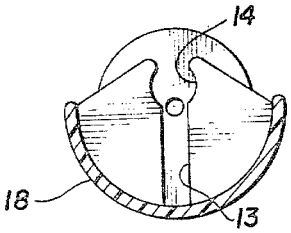
FIG. 13 is a view of the brush holder.
Figure 14:
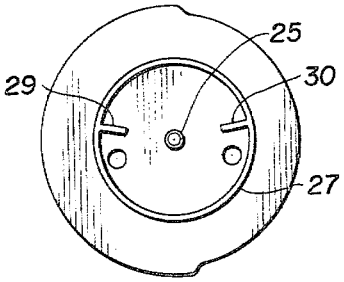
FIG. 14 is a bottom view of the brush holder door closure.

The brush holder door closure 18 is shown in cross section in FIG. 3. FIG. 13 illustrates more plainly the brush holder side of the brush holder enclosure door. As seen in this view, the enclosure door 18 includes an indentation 40 formed vertically in its surface which provides a hand-gripper by which the enclosure door may be rotated by gripping with the fingers. The drop cup 31 is supported on the bottom of the rotatable enclosure and slides under side protrusions 41 to prevent tipping of the cup when in place. This view also shows the slot 13 in the brush holder. The brush holder is shown more plainly in FIG. 13. FIG. 13 illustrates the arcuate shaped holder which snaps around the handle 16 of the brush to hold the brush in place. FIG. 14 is a bottom view which more clearly shows the ribs or stops 29, 30 on the bottom of the rotatable brush holder enclosure door. One stop rests against the stop pin when the enclosure door is closed. Thus, the enclosure door cannot be rotated too far in the open or closed position.

The brush holder is assembled prior to installation in the wall of a bathroom. In assembly, the rotatable brush holder enclosure door is held in place in the rear housing so that the downwardly protruding stops are outwardly of the stop pin. The upper pivot pin is inserted through the holes in the rear housing into the hole in the upper wall of the brush holder enclosure door. The bottom bushing is inserted through the hole in the bottom of the rear housing so that the downwardly protruding integral pivot pin on the brush holder enclosure door is inserted into the bushing. The stop pin can now be inserted if it was not previously inserted. The upper pivot pin, the bottom bushing, and the stop pin all have a tight fit in the rear housing so that they will be retained in the housing. Subsequent to securing the brush holder enclosure door in the rear housing, the front housing is secured to the rear housing. In order that the screws do not show through the front cover, the screws are passed through the back housing and screwed into the flange in the front cover. The flange on the front cover has an angular edge so that the flange edge fits over and to the outside of the flange circumference on the rear housing.

The width and length of the recessed portion of the rear housing is made with a width and length such that the brush holder will fit into the area of three regular wall tiles. Therefore, by removing three wall tiles and cutting away the wall board behind the three tiles, the brush holder can be secured to the wall. In order to secure the device to the wall, a strip of protected mastic can be applied to the flange of the rear housing and the holder secured to the wall by removal of the protective coating and pressing the brush holder mastic to the wall. Therefore, the brush holder can be secured to the wall with very little effort and with minimum tools.

Obviously the brush holder can be used for other purposes than for a toilet brush. Likewise it may be made of any desired size to accommodate the brush of interest, such as tooth brushes. Further the enclosure door may have more than one supporting shelf each of which may support more than one brush.

The foregong relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A wall mounted enclosure device for mounting at least one brush and the like, comprising:

a back housing, said back housing including a recessed cavity formed by side, bottom, and top walls, said side walls coverging toward each other from said bottom walls toward said top wall, and a flange extending outwardly from said top, bottom and side walls in the same vertical plane;

a front enclosure secured to said back housing;

said front enclosure including a central opening that conforms with said walls of said back housing, said front enclosure further including an outwardly extending flange with its outer circumference having an angular end that extends over and surrounds said flange on said rear housing to enclose said flange of said rear housing, a recessed brush holder enclosure door rotatably supported by said rear housing and partially enclosed by said front enclosure;

said enclosure door including top and bottom horizontally extending parallel flanges, said top flange including an aperture therein, said bottom flange including a downwardly extending first pivot pin for mounting said enclosure door to said back housing for pivotable motion therein, and spaced ribs extending downwardly from said bottom flange and equally spaced from said first pivot pin;

a second pivot pin extending through said top wall of said rear housing into said aperture in said enclosure door and a bushing extending through said bottom wall of said rear housing for receiving said first pivot pin for pivotably mouting said enclosure door within said back housing and said front enclosure; and an unexposed stop means extending upwardly from said bottom wall of said rear housing for cooperating with said spaced ribs on said enclosure door for positioning said enclosure door in either an open or closed position, at least one shelf rigidly supported by said enclosure door and extending across the recess therein for securing at least one brush on said recessed brush holder enclosure door;

whereby said enclosure door encloses said rear housing and said at least one brush when in the closed position and exposes said at least one brush when in the open position.

2. The device of claim 1, wherein said shelf has a slot extending inwardly thereof from the outer edge thereof for receiving a brush handle to suspend the brush end thereof below said shelf and in the recess of said brush holder enclosure door.

3. The device of claim 2, wherein a drip catcher is carried by said door, and said brush extends into said drip catcher.

4. The device of claim 1, wherein said enclosure door includes protrusions thereon below said shelf and a drip catcher supported between said protrusions and the bottom of said enclosure door.

5. A wall mounted enclosure device as claimed in claim 1, in which:

said front enclosure includes an outwardly extending wall portion at an angle to the flange; and an inwardly extending wall portion integral with said outwardly extending wall portion, said inwardly extending wall portion surrounding said brush holder enclosure door.

* * * * *